United States Patent [19]

Maeda et al.

[11] Patent Number: 4,626,666

[45] Date of Patent: Dec. 2, 1986

[54] SELF-REGULATING ELECTRIC HEATER

[75] Inventors: Masatoshi Maeda; Toshio Kusunoki; Yoji Iguchi, all of Hikone, Japan

[73] Assignee: Matsushita Electric Works, Ltd., Osaka, Japan

[21] Appl. No.: 662,143

[22] Filed: Oct. 18, 1984

[30] Foreign Application Priority Data

Nov. 18, 1983 [JP] Japan ..... 58-218351

[51] Int. Cl.[4] ..... H05B 3/02; H05B 1/02; H01C 7/02

[52] U.S. Cl. ..... 219/537; 219/302; 219/306; 219/315; 219/336; 219/505; 219/530; 219/539; 219/540; 219/541; 219/544; 338/22 R

[58] Field of Search ..... 219/302, 306, 316, 318, 219/320, 321, 335, 336, 504, 505, 530, 540, 541, 544, 539, 222, 315, 537; 338/22 R, 23

[56] References Cited

U.S. PATENT DOCUMENTS

| | | | |
|---|---|---|---|
| 1,308,836 | 7/1919 | Bernard | 219/320 |
| 3,584,189 | 6/1971 | Marcoux | 219/504 X |
| 4,123,851 | 11/1978 | Itoh et al. | 219/504 X |
| 4,147,927 | 4/1979 | Pirotte | 219/537 X |
| 4,223,208 | 9/1980 | Kleinschmidt et al. | 219/504 X |
| 4,242,567 | 12/1980 | Carter | 219/539 X |
| 4,327,282 | 4/1982 | Nauerth | 219/539 X |
| 4,341,949 | 7/1982 | Steiner et al. | 219/505 X |
| 4,401,885 | 8/1983 | Ishii et al. | 219/505 X |
| 4,418,272 | 11/1983 | Roller et al. | 338/22 R |
| 4,426,573 | 1/1984 | Fudickar et al. | 219/505 X |
| 4,468,555 | 8/1984 | Adachi et al. | 219/505 X |

FOREIGN PATENT DOCUMENTS

| | | | |
|---|---|---|---|
| 22878 | 1/1981 | European Pat. Off. | 219/505 |
| 3042420 | 6/1982 | Fed. Rep. of Germany | 219/505 |
| 3041597 | 6/1982 | Fed. Rep. of Germany | 219/222 |
| 52-138261 | 11/1977 | Japan . | |
| 139140 | 10/1979 | Japan | 219/505 |
| 11875 | 2/1981 | Japan | 219/505 |

*Primary Examiner*—A. Bartis

*Attorney, Agent, or Firm*—Stevens, Davis, Miller & Mosher

[57] ABSTRACT

A self-regulating electric heater includes a plurality of ceramic PTC resistors having flat contact surfaces on their opposite sides disposed between a pair of flat electrode plates with the contact surfaces in electrical and thermal contact with the plates. A support frame of electrically insulative material is formed with receiving portions respectively for the PTC resistors and the electrode plates to positions and hold the resistors and plates in assembled relationship for insertion as a single assembly into a closed-end cavity in a metallic radiator with the electrode plates in good heat transfer contact with the inner wall surface of the cavity. The frame is provided with spring seats receiving springs which coact with the radiator to bias the support frame into the cavity to insure stable intimate thermal contact between the electrode plates and inner cavity wall. The PTC resistors may be provided with chamfered edges along the peripheries of the flat contact surfaces thereof. The electrode plates may be provided with a beveled corner adjacent to the closed end of the cavity to avoid stress between the plates and cavity wall when the support frame is inserted into the cavity.

7 Claims, 9 Drawing Figures

SELF-REGULATING ELECTRIC HEATER

BACKGROUND OF THE DISCLOSURE

1. Fields of the Invention

The present invention relates to a self-regulating electric heater employing a resistor of positive temperature coefficient of resistivity (hereinafter referred to as PTC resistor) as a heating element, and more particularly to a self-regulating electric heater such as may be adapted to an oral inhalation device for producing steam which is to be inhaled in spray form together with suitable medicines carried on the steam.

2. Description of the Prior Art

Such PTC resistor has been found to be advantageous when used as heaters because of its self-regulating characteristic. However, the size of the PTC resistor is practically limited to be comparatively small so that the amount of heat dissipated therefrom is limited to a lower level. Therefore, there have been proposed for the purpose of increasing heat transfer efficiency many schemes to reduce as much as possible heat loss in transferring the heat derived from the PTC resistor to a casing to which it is attached together with electrodes supplying electricity to the PTC resistor and from which the heat is dissipated for heating purpose. Among the above schemes is to have the electrodes in pressing contact with the casing to provide a close and stable heat transfer relation therebetween as disposing the PTC resistor between the electrodes. Exemplary of the above is shown in U.S. Pat. No. 4,147,927 for a self-regulating heating element in which two electrically and thermally conductive flat strips or electrodes parallel to and spaced from each other are positioned in a longitudinally arranged tubular body with one or more PTC resistors between and in electrical and heat-exchange contact with the parallel flat strips. The flat strips are inserted in the tubular body to be in resilient contact with the inner surface of the body while the PTC resistors are fixed between the strips by respective layers of solder. However, such soldering connection between the PTC resistors and the strips should require a maximum contacting area therebetween for maintaining the heat transfer efficiency, which can be only achieved with a careful and skillful soldering technique, therefore rendering the assembly of the heater cumbersome. Also from the point of view that the solder is likely to melt at the operating temperature of the heater so as to render the PTC resistors no longer fixed on the strips, the PTC resistors are susceptible to possible mechanical shocks acted upon the heater such that they might be moved out of optimum electrical and heat transfer relation from the strips, rendering the heater ineffective. But without such soldering connection, the assembly of the members into the body would be much complicated since the strips and the PTC resistors, which are the separate members, must be inserted in the body at a time in such a way as to be correctly positioned with respect to each other and to the body. Accordingly, for satisfying easier assembling as well as stable and effective thermal contact between the PTC resistors and the electrodes, it is required to support the PTC resistor in correct position relative to the electrodes without using the solder and the like prior to assembling these members into the body or casing. However, there is no provision in the prior art for the above construction.

SUMMARY OF THE INVENTION

The above disadvantages have been obviated by the present invention which introduces a unique support frame for mounting thereon at least one PTC resistor and electrode plates supplying electric power thereto respectively at fixed positions relative to each other. The support frame carrying the above members is received in a cavity of a radiator so that the electrode plates are in heat transfer contact with the inner surface of the radiator defining the cavity. On the side of the support frame, the PTC resistor and the electrode plates are disposed in respective receiving portions so that the PTC resistor is kept in electrical and heat transfer relation to the electrode plates. Accordingly, the PTC resistor and the electrode plates are cooperative with the support frame to provide a single structure which can be easily inserted in the cavity of the radiator as maintaining the PTC resistor in proper position relative to the electrode plates during the assembly. The PTC resistor thus kept in fixed position relative to the electrode plates on the support frame will not become out of the initial proper contacting relation with the electrode plates when subjected to possible shocks applied to the heater after the assembly.

It is therefore a primary object of the present invention to provide a self-regulating electric heater capable of being easily assembled yet assuring stable and shock-free contact relationship of the PTC resistor with the electrodes thereof.

In a preferred embodiment, said support frame is formed with spring seats each for receiving the one end of a spring which has the other end connected to the radiator. The spring serves to urge the support frame into the cavity in the direction of biasing the electrode plates into close heat transfer contact with the inner surface of the radiator. With the result of this, the support frame carrying the PTC resistor and the electrode plates is held firmly in the cavity to make the electrode plates kept in close contact with the inner surface of the cavity, eliminating the shaking of the electrode plates in the cavity which would otherwise impair the efficiency to a certain extent in transmitting the heat from the electrode plates to the radiator.

It is accordingly another object of the present invention to provide a self-regulating electric heater which keeps maximum heat transfer relation between the electrode plates and the radiator over a longer time period of use and in which the spring employed for this purpose can be readily seated on the support frame to facilitate the assembly of the heater.

Said support frame consists of a plate member to be inserted in the correspondingly shaped cavity of the radiator and is formed in opposite surfaces thereof with recesses respectively for receiving the electrode plates and also formed therein with at least one penetrating hole for receiving the PTC resistor in the form of a flat mass having substantially flat contacting surfaces spaced from one another on the opposite sides thereof. Said hole for the PTC resistor is shaped to be open at its both ends into the respective recesses and to have a depth smaller than the thickness of the PTC resistor such that the electrode plates in said recesses can be in electric and heat transfer contact with substantially the entire flat surfaces of the PTC resistor in said hole, respectively, whereby the PTC resistor can be held by the support frame in such a manner as to be kept in maximum heat transfer relation with the respective electrode plates.

It is a further object of the present invention to provide a self-regulating electric heater which assures maximum heat transfer relation between the PTC resistor and the electrode plates and therefore between the PTC resistor and the radiator.

In addition, each of said electrode plates is formed with a terminal portion which extends outwardly of the cavity for supplying electric power to the PTC resistor. This facilitates the electrical connection of the heater with a power source, which is a still further object of the present invention.

In the present invention, there are disclosed still other useful features including schemes for protecting the PTC resistor, which is in most cases is fragile, from being damaged due to forces possibly acting between the radiator and the support frame at the time of inserting the support frame in the cavity of the radiator.

These and other advantages become more apparent from the following detailed description of the embodiment when taken in conjunction with the accompanying drawings.

DETAILED DESCRIPTION OF PREFERRED EMBODIMENT

Figure 1:
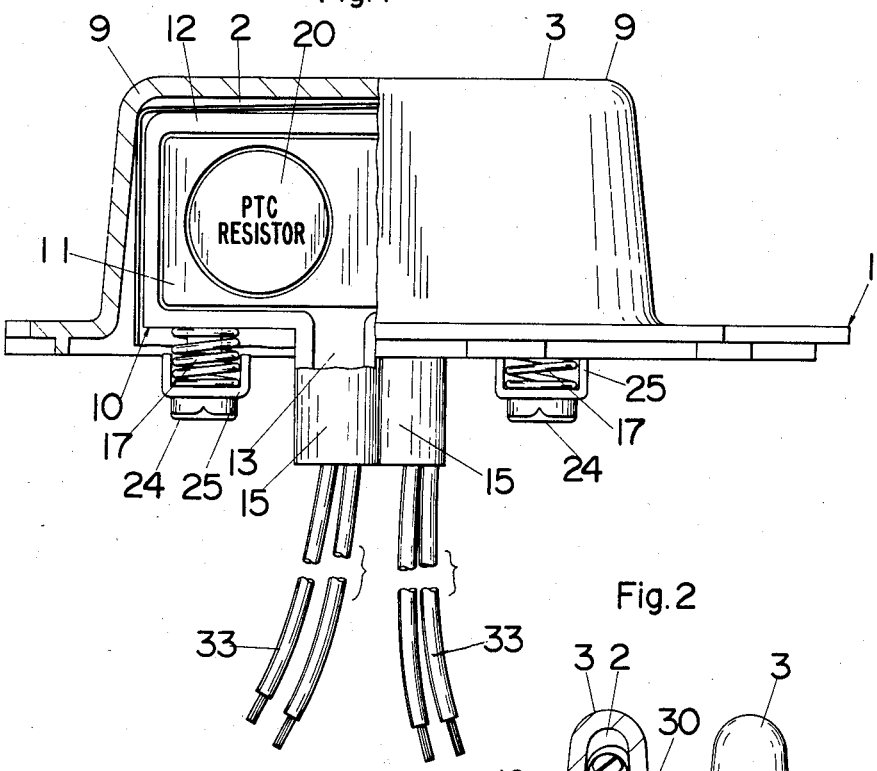
FIG. 1 is a front view, partly in section and partly in elevation, showing a self-regulating electric heater according to a preferred embodiment of the present invention.
Figure 2:
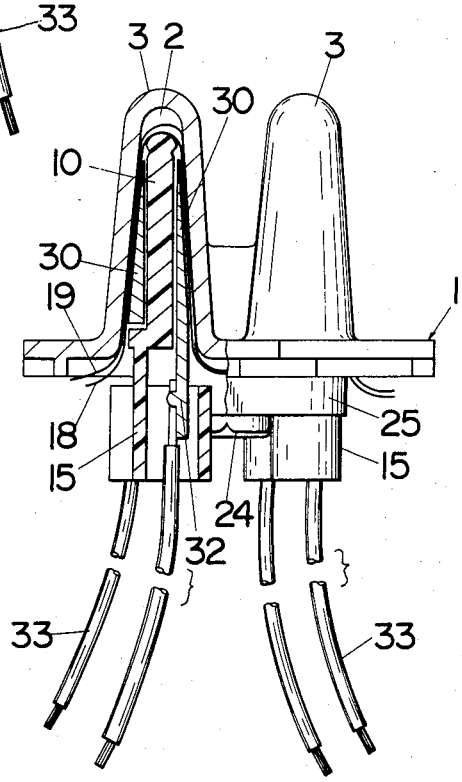
FIG. 2 is a side view, partly in section and partly in elevation, of the above heater.
Figure 3:
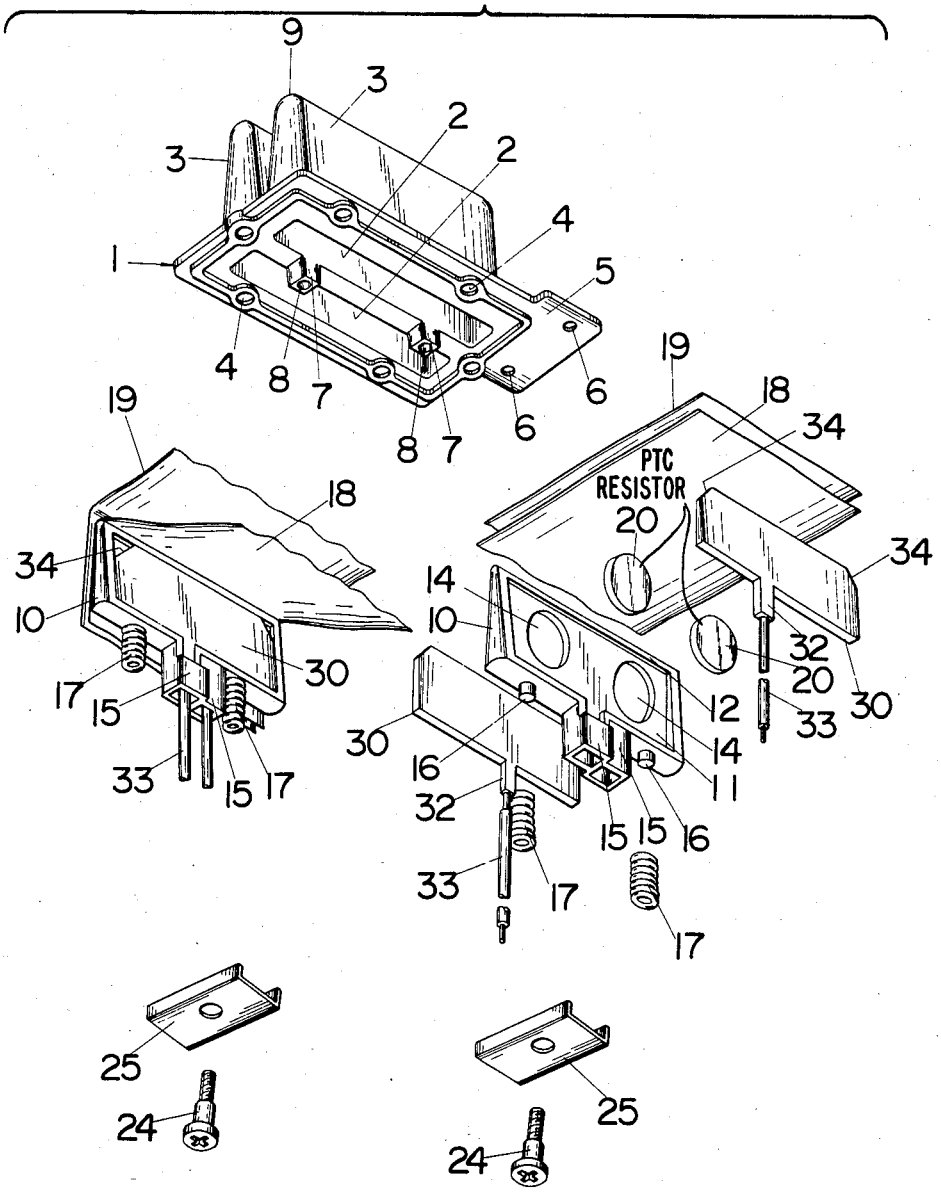
FIG. 3 is an exploded view in perspective representation of the above heater.
Figure 4:
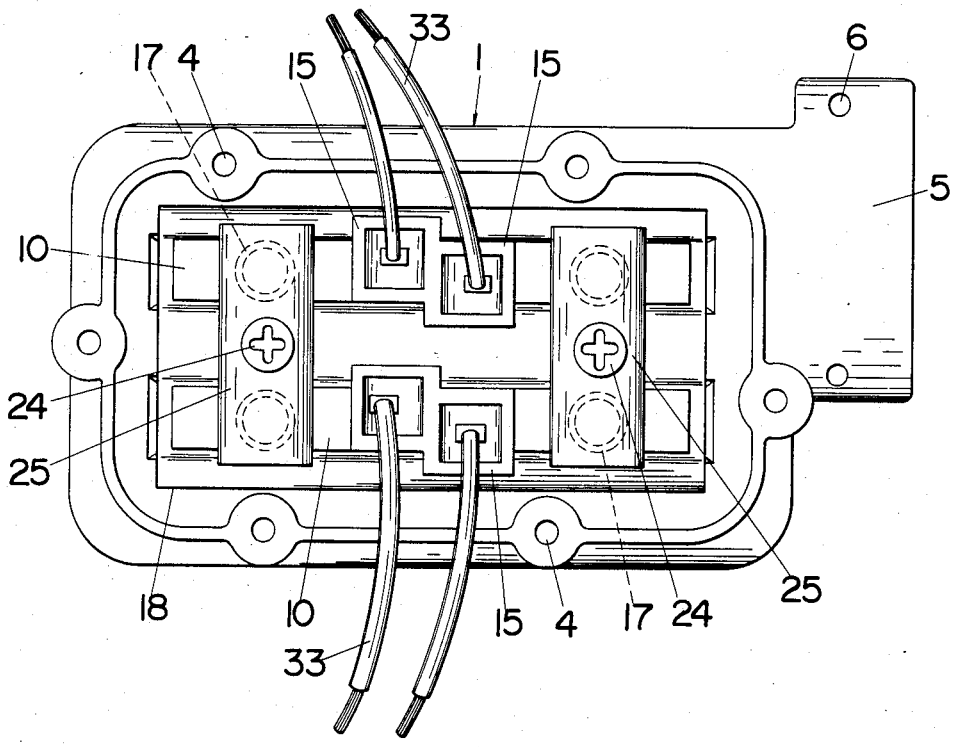
FIG. 4 is a bottom view of the above heater.

Referring now to FIGS. 1 to 3, there is illustrated a self-regulating electric heater in accordance with a preferred embodiment of the present invention. The heater comprises a radiator 1 formed with a pair of parallel cavities 2 each for receiving a support frame 10 of insulative material which carries thereon two pieces of PTC resistors 20 and a pair of electrode plates 30 in such a manner that each PTC resistor 20 is in electrical and heat transfer contact with the electrode plates 30. The radiator 1 is made of a high thermal conductive material such as zinc and aluminium and is shaped by the known die-casing method to have said cavities 2 each in the form of a laterally elongated and deep configuration with a generally inverted V-shaped cross section closed at the upper end and opened at the lower end, each cavity 2 defining on the upper surface of the radiator 1 correspondingly shaped rib 3 and being narrower toward the rounded top than at the lower end defining a rectangular opening through which the said support frame 10 is inserted. Formed in the peripheral portion of the radiator 1 are holes 4 through which fasteners such as screws are inserted for fixing the radiator to a device utilizing the heater. An extension plate or lug 5 with holes 6 is also provided for fixing the radiator 1.

Said support frame 10 is made of electrically insulative and heat-resistant material, for example, polyphenylene sulfide in the form of a plate member with a wedge-shaped cross section at the longitudinal ends. Rectangular recesses 11 respectively for receiving therein said electrode plates 30 are formed in the opposite sides of the support frame 10 in such a way that each recess 11 leaves therearound a peripheral rim 12 which is only interrupted at 13 intermediate the length of the lower edge of support frame 10 and which has at its side portions inclined surfaces conforming with the inner wall of said cavity 2. Also formed in the support frame 10 are spaced holes 14 each of which is opened into the recesses 11 on both sides of the support frame 10 for receiving one PTC resistor 20. Said PTC resistor 20 is in the form of a rounded disk-like mass made of a ceramic material to have on the opposite sides thereof contacting surfaces which are substantially flat and spaced from each other. Each of said holes 14 is designed to have a depth less than the thickness of the PTC resistor 20 to a slight extent, so that the PTC resistor 20, when received in the hole 14, has its contacting surfaces projecting slightly into the recesses 11, whereby substantially the entire contacting surfaces of the PTC resistors 20 are in electrical and heat transfer contact with the electrode plates 30 received in the adjacent recesses 11, as shown in FIG. 6.

Figure 5:
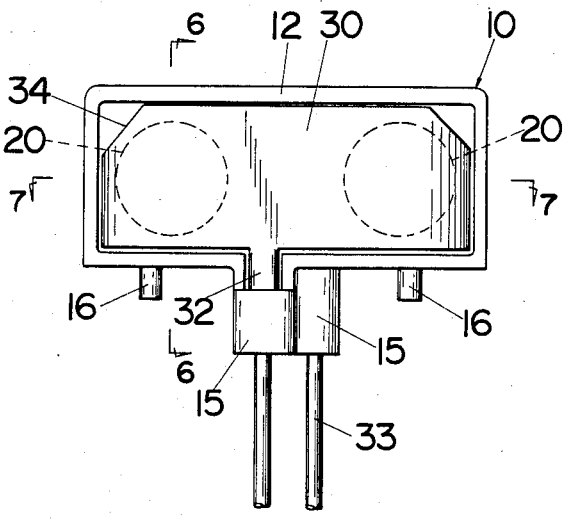
FIG. 5 is a front view of a support frame with electrode plates mounted thereon employed in the above heater.
Figure 6:
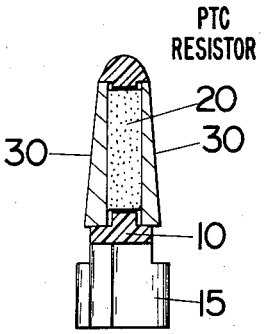
FIG. 6 is a sectional view taken along line 6—6 of FIG. 5.
Figure 7:
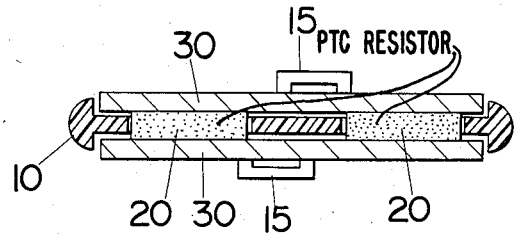
FIG. 7 is a sectional view taken along line 7—7 of FIG. 5.

Each of said electrode plates 30 is made of a high thermal conductivity material, for example, copper to be in the form of a rectangular plate with a wedge-shaped cross section defined by a vertical surface on one side and an inclined surface with respect thereto on the other side thereof and is so dimensioned that, when fitted in each one of said recesses 11 with the vertical surface being in electrical and thermal contact with the contacting surfaces of the PTC resistors 20, said inclined surface projects slightly on the general outer surface of the support frame 10, as shown in FIGS. 6 and 7, while its periphery being within the confines of said rim 12, as shown in FIG. 5. Extending integrally from the lower edge of each electrode plate 30 is a terminal lug 32 which projects through the interruption 13 of said rim 12 into one of tubular sockets 15 of the support frame 10 in which it is connected to one end of a lead 33 for receiving electric current from a suitable power source. Said tubular sockets 15 extends integrally from the intermediate portion of the bottom of the support frame 10 to be arranged side by side at such portions that they project outwardly of the cavity 2 or downwardly below the bottom surface of the radiator 1 when the support frame 10 is received in the cavity 2. Also integral with the support frame 10 are a pair of bosses 16 which project downwardly on both sides of said sockets 15, each serving as a spring seat on which is fitted the one end of a coil spring 17 of heat-resistant stainless steel used to fasten the support frame 10 to the radiator 1.

The support frame 10 after receiving the PTC resistors 20 and the electrode plates 30 in respective positions is wrapped by an insulative and heat-resistant adhesive film 18 of polyimide-amide in such a manner that the surfaces of the electrode plates 30 are fully and tightly covered thereby, said film 18 is further wrapped by another insulative sheet 19 of high thermal conductive material such as a silicon rubber having alumina particles dispersed therein to thereby constitute a heater block which can be inserted as a single structure into the cavity 2. With this arrangement, double-insulation can be effected between the electrode plates 30 on the support frame 10 and the wall of the cavity 2 of the radiator 1. In the figures, although the two support frames 10 are wrapped by the common film 18 and the common sheet 19, they may be wrapped separately by the film 18 and the sheet 19.

Said radiator 1 is provided on its bottom with integral studs 7 with screw holes 8 which are located between the bottom openings of the cavities 2 and spaced longitudinally of the radiator 1 and which receive respectively screws 24 fixing brackets 25 onto the bottom of the radiator 1. It is these brackets 25 against which the opposite ends of said springs 17 bear respectively so that said heater blocks are fixedly held within the respective cavities 2. A pair of said springs 17 urge each heater block into the corresponding cavity 2 in such a way that the electrode plates 30 on both sides of the block are pressed through said insulative film 18 and sheet 19 against the inner wall of the cavity 2, as shown in FIG. 1. This makes the electrode plates 30 to be in close heat transfer relation to the radiator 1 while the radiator 1 is kept insulated for efficiently dissipating the heat derived from the PTC resistors 20 to radiator 1 through the electrode plates 30 in a safe manner. It is noted at this time that the biasing force of the springs 17 also acts to press the electrode plates 30 against the PTC resistors 20 as a result of the wedge bonding of the electrode plates 30 to the inner wall of the cavity 2 for ensuring close electric and thermal relation therebetween which is free from possible shocks applied to the heater. Thus, the electrode plates 30 are kept over the operating life of the heater to be in optimum electrical and heat transfer relation to the PTC resistors 20 as well as to be in optimum heat transfer relation to the radiator 1, enabling the heater to operate at its maximum efficiency during the use thereof.

In the present embodiment, each electrode plate 30 is provided respectively at its upper corner portions with bevelled edges 34, as shown in FIGS. 3 and 5, to eliminate the possibility of creating a pressure point between the electrode plate 30 and the inner surface of the cavity 2. Said corner portions 9 of the cavity 2 are not biased when the heater block is biasingly received in the cavity 2 and would otherwise certainly exert forces on an electrode plate 30 without said bevelled edges 34 or without the upper corner portions of the electrode plate 30 being cut away. Such forces, if present, would in turn adversely damage the PTC resistors that are held in close contact with the electrode plate 30 and are fragile due to their ceramic construction. Accordingly, said bevelled edges 34 are found to be advantageous for avoiding the application of such forces to the electrode plates 30 and to the PTC resistors 20, thus protecting the PTC resistors 20 from being damaged.

Figure 8:
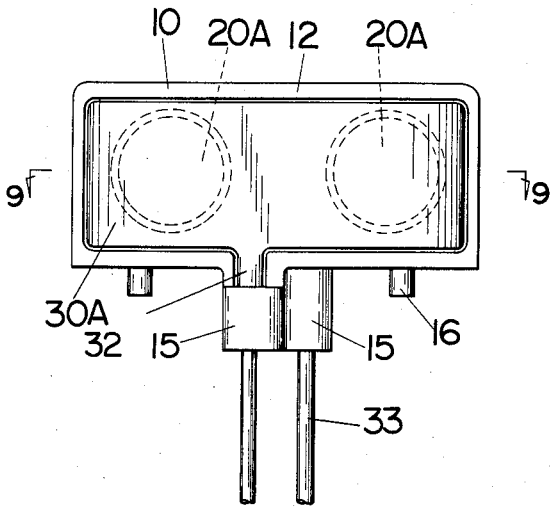
FIG. 8 is a front view of a support frame with electrode plates mounted thereon in accordance with a modification of the above embodiment.
Figure 9:
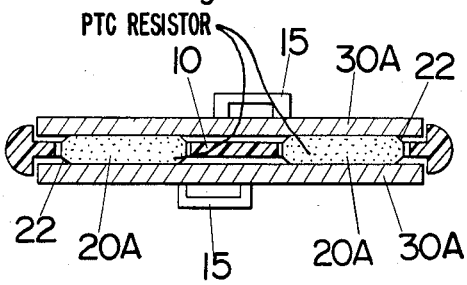
FIG. 9 is a sectional view taken along line 9—9 of FIG. 8.

FIGS. 8 and 9 show a modification of the above embodiment in which chamfered edges 22 are formed along the peripheries of the contacting surfaces engaged by electrodes 30A on both sides of each PTC resistor 20A or along the portions that are most sensible for the above-mentioned forces. Thus, this modification provides an alternative measure of protecting the PTC resistor 20A by forming the chamfered edges 22 thereon instead of forming said bevelled edges 32 on the electrode plate 30 as seen in the above embodiment.

What is claimed is:

1. A self-regulating electric heater comprising:

a radiator formed of a dimensionally stable material, said radiator having a cavity;

a pair of electrode plates;

at least one PTC resistor arranged in electric and heat transfer contact with said electrode plates; and a support frame of electrically insulative material, said frame being formed with receiving portions respectively for said at least one PTC resistor and the electrode plates for holding the same in said electric and thermal contact, said frame being received in said cavity with both of said electrode plates in heat transfer contact with an inner wall of the cavity:

spring means, having two ends, one end of which is connected to said radiator; and spring seat means on said support frame for receiving the other end of said spring means, said spring means urging the support frame into the cavity in the direction of biasing the electrode plates into intimate heat transfer contact with the inner wall of the cavity.

2. The self-regulating electric heater as set forth in claim 1, wherein said support frame is provided with a separate receiving portion for each one of said at least one PTC resistor electrically connected between said electrode plates.

3. The self-regulating electric heater as set forth in claim 1, wherein said support frame is in the form of a plate member having a shape corresponding to the shape of the cavity of the radiator, said plate member is formed in opposite surfaces with recesses defining said receiving portions for the electrode plates and is formed therein with a penetrating hole defining the receiving portion for each of said at least one PTC resistor, each PTC resistor being received in a hole and having substantially flat contacting surfaces on the respective opposite sides thereof, said penetrating hole having both its ends open into said recesses respectively and having a depth smaller than the thickness of the PTC resistor such that the electrode plates in said recesses are in electric and heat transfer contact with substantially the entire flate surfaces of the PTC resistor in said hole, respectively.

4. The self-regulating electric heater as set forth in claim 1, wherein each of said electrode plates is formed with a terminal portion which extends outwardly of the cavity for supplying electric power to said at least one PTC resistor.

5. The self-regulating electric heater as forth in claim 1, wherein said at least one PTC resistor has substantially flat contact surfaces on the opposites sides thereof and is made and said at least one PTC resistor has chamfered edges respectively along the peripheries of said flat contact surfaces.

6. A self-regulating electric heater comprising:

a radiator formed of a dimensionally stable material, said radiator having a cavity;

a pair of electrode plates;

at least one PTC resistor arranged in electirc and heat transfer contact with said electrode plates; and a support frame of electrically insulative material, said frame being formed with receiving portions respectively for said at least one PTC resistor and the electrode plates for holding the same in said electric and thermal contact, said frame being received in said cavity with both of said electrode plates in heat transfer contact with an inner wall of the cavity, wherein said support frame is in the form of a plate member having a shape corresponding to the shape of the cavity of the radiator, said plate member is formed in opposite surfaces with recesses defining said receiving portions for the electrode plates and is formed therein with a penetrating hole defining the receiving portion for each of said at least one PTC resistor, each PTC resistor being received in a hole and having substantially flat contacting surfaces on the respective opposite sides thereof, said penetrating hole having both its ends open into said recesses respectively and having a depth smaller than the thickness of the PTC resistor such that the electrode plates in said recesses are in electric and heat transfer contact with substantially the entire flat surfaces of the PTC resistor in said hole, respectively, wherein said cavity has a closed end and said at least one PTC resistor is made of ceramic material and wherein each of the electrode plates has beveled corner edges adjacent to said closed end of said cavity of the radiator for avoiding excess stress from being between the electrode plates and the wall of the cavity when th support frame is assembled into the cavity.

7. The self-regulating electric heater as set forth in claim 6, wherein said at least one PTC resistor is made of cermic material and said at least one PTC resistor has chamfered edges respectively along the peripheries of said flat contact surfaces on the opposite sides thereof.

* * * * *